US007542897B2

(12) United States Patent
Hutchison et al.

(10) Patent No.: US 7,542,897 B2
(45) Date of Patent: Jun. 2, 2009

(54) CONDENSED VOICE BUFFERING, TRANSMISSION AND PLAYBACK

(75) Inventors: James A. Hutchison, San Diego, CA (US); Sun Tam, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 625 days.

(21) Appl. No.: 10/233,251

(22) Filed: Aug. 29, 2002

(65) Prior Publication Data

US 2004/0039566 A1 Feb. 26, 2004

(51) Int. Cl.
*G10L 11/06* (2006.01)

(52) U.S. Cl. ..... 704/214; 704/210; 704/215; 704/201; 704/233; 704/211

(58) Field of Classification Search ..... 704/210, 704/215, 214, 201, 233, 211
See application file for complete search history.

(56) References Cited

U.S. PATENT DOCUMENTS

| | | | | |
|---|---|---|---|---|
| 5,742,930 | A * | 4/1998 | Howitt | 704/502 |
| 5,819,215 | A * | 10/1998 | Dobson et al. | 704/230 |
| 5,819,217 | A * | 10/1998 | Raman | 704/233 |
| 5,897,613 | A * | 4/1999 | Chan | 704/210 |
| 5,926,090 | A * | 7/1999 | Taylor et al. | 340/568.1 |
| 6,049,765 | A * | 4/2000 | Iyengar et al. | 704/201 |
| 6,631,139 | B2 * | 10/2003 | El-Maleh et al. | 370/466 |
| 6,856,961 | B2 * | 2/2005 | Thyssen | 704/500 |
| 6,865,162 | B1 * | 3/2005 | Clemm | 370/286 |
| 7,039,055 | B1 * | 5/2006 | Luong | 370/395.2 |
| 2002/0101844 | A1 | 8/2002 | El-Maleh et al. | 370/342 |
| 2003/0093267 | A1 * | 5/2003 | Leichtling et al. | 704/215 |

FOREIGN PATENT DOCUMENTS

EP 0321672 10/1988

OTHER PUBLICATIONS

Jacobs, S., et al.: "Silence detection for multimedia communication systems", Multimedia Syst. (Germany), Multimedia Systems, Mar. 1999. Springer-Verlag, Germany, vol. 7, No. 2, 1999, pp. 157-164.
Dhadesugoor, V. Et al.: "Digital Silence Detection in Delta Modulation Packet Voice Networks" International Conference on Communications. Boston, Jun. 10-14, 1979, New York, IEEE US, vol.. vol. 2, Jun. 1979, pp. 24701-24705.

(Continued)

*Primary Examiner*—Vijay B Chawan
(74) *Attorney, Agent, or Firm*—Howard H. Seo; Darren M. Simon

(57) ABSTRACT

This disclosure is directed to techniques for condensed voice buffering, transmission and playback. The techniques may involve identification of encoded voice frames as either speech or a pause, and selective exclusion of a portion of the frames for storage, transmission or playback based on the identification. In this manner, the techniques are capable of condensing a series of encoded voice frames. When variable rate coding is employed, a pause frame may be identified, for example, based on a threshold comparison for the rate of the encoded frame. In some cases, the techniques may involve excluding only a portion of the identified frames from a consecutive sequence of the identified frames, thereby preserving a minimum number of the identified frames needed for intelligible conversation.

21 Claims, 7 Drawing Sheets

OTHER PUBLICATIONS

Loo, C. et al. "An Adaptive silence deletion algorithm for compression of telephone speech"; Communications, Computers and Signal Processing, 1997. 10 Years Pacrim 1987-1997-Networking the Pacific Rim.

Rose C. et al.: "Real-time implementation and evaluation of an adaptive silence deletion algorithm for speech compression" Communications, Computers and Signal Processing, 1991., IEEE Pacific Rim Conference on Victoria, BC, Canada, 9-10, (May 9, 1999), pp. 461-468.

Anonymous: "Compression Method for Voice Preprocessing and Postprocessing" TDB, XX, XX vol. 29, No. 4, Sep. 1, 1986, pp. 1756-1757.

3rd Generation Partnership Project; Technical Specification Group Services and System Aspects; Digital cellular telecommunication system (Phase 2+); Discontinuous Transmission (DTX) for Adaptive Multi-Rate (AMR) speech traffic channels (Release 1998), Global System for Mobile Communications, 3GPPTS 06.93 v7.5.0 (2000).

* cited by examiner

CONDENSED VOICE BUFFERING, TRANSMISSION AND PLAYBACK

FIELD

This disclosure relates generally to voice communication and, more particularly, to processing voice information for recording, transmission and playback.

BACKGROUND

Communication of voice information using digital techniques generally involves the use of a voice encoder, sometimes referred to as a voice CODEC or vocoder. The voice encoder samples, digitizes and compresses voice information, e.g., speech, for transmission as a series of frames. Many voice encoders provide variable rate encoding. For example, different types of voice information, such as speech, background noise, and pauses can be encoded at different data rates. Compression enables the voice information to be transmitted at a reduced data rate, e.g., over a wired or wireless transmission channel. Voice information may be digitally transmitted, for example, over packet-based networks, such as networks supporting Voice-Over-IP (VOIP).

Frame-based voice encoding techniques, such as Qualcomm Code Excited Linear Predictive Coding (QCELP), Enhanced Variable Rate Codec (EVRC), and Selectable Mode Vocoder (SMV), encode moments of sound into sequences of bits. The bit sequences represent the sound during the encoded moments, and are commonly referred to as frames. Typically, the encoded frames represent a continuous stream of voice information that is later decoded and synthesized to produce audible output. In particular, the encoded frames may contain parameters that relate to a model of human speech generation. Recognizable speech typically includes pauses following utterances. Accordingly, some of the encoded frames contains the coding of pauses in speech. A decoder uses the parameters received over a transmission channel to resynthesize the speech for audible playback.

SUMMARY

This disclosure is directed to techniques for condensed voice buffering, transmission and playback. The condensation techniques may involve identification of encoded voice frames as either speech or a pause, and selective exclusion of frames, for storage, transmission or playback, based on the identification. In this manner, the techniques are capable of condensing a series of encoded voice frames. Condensation may be effective in reducing the amount of frames stored in memory, transmitted between devices, or decoded and synthesized for playback.

When variable-rate coding is employed, a pause frame may be identified, for example, based on a threshold comparison for the rate of the encoded frame. Other voice coding techniques may explicitly indicate frames of silence. Some voice coding techniques include noise estimates in the pause frames. In some cases, the techniques may involve excluding only a portion of the identified frames from a consecutive sequence of the identified frames, thereby preserving a minimum number of the identified frames needed for intelligible conversation.

In one embodiment, a method comprises identifying encoded voice frames representing a pause, and excluding at least some of the identified frames from a series of frames.

In another embodiment, a device comprises a voice encoder and a processor. The voice encoder generates encoded voice frames. The processor identifies encoded voice frames representing a pause, and excludes at least some of the identified frames from a series of frames.

In a further embodiment, a machine-readable medium comprises instructions to cause a processor to identify encoded voice frames representing a pause, and exclude at least some of the identified frames from a series of frames.

In an added embodiment, a machine-readable medium comprises a series of encoded voice frames representing a speech sequence. The series of encoded voice frames omit at least some of the encoded voice frames representing pauses in the speech sequence.

In another embodiment, a system comprises first and second voice communication devices. The first voice communication device has a voice encoder that generates encoded voice frames, a processor that identifies encoded voice frames representing a pause, and excludes at least some of the identified frames from a series of the frames, and a transmitter that transmits the series of frames. The second voice communication device has a receiver that receives the series of frames transmitted by the first communication device, and a voice decoder that decodes the series of frames for playback.

Additional details of these and other embodiments are set forth in the accompanying drawings and the description below. Other features will become apparent from the description and drawings, and from the claims.

DETAILED DESCRIPTION

Figure 1:
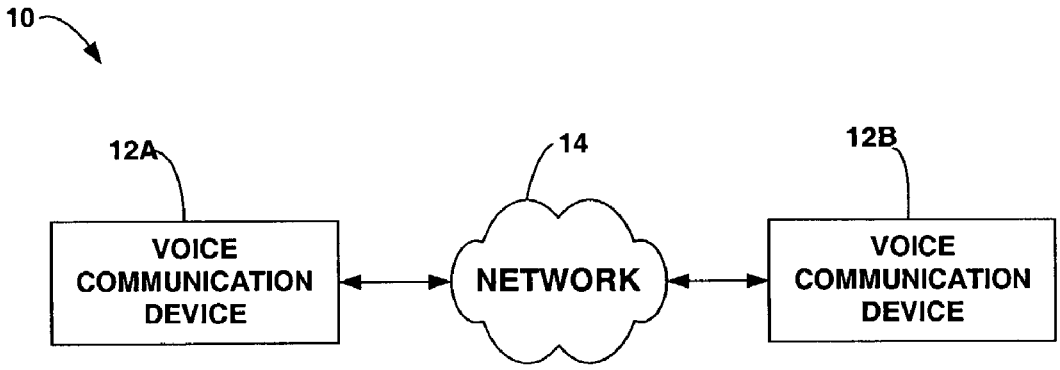
FIG. 1 is a block diagram illustrating an exemplary voice communication system that employs techniques for condensed voice buffering, transmission and playback.

FIG. 1 is a block diagram illustrating a voice communication system 10. As shown in FIG. 1, system 10 may include two or more voice communication devices 12A, 12B (hereinafter 12) that communicate voice information via a network 14. Exemplary voice communication devices 12 may include conventional land-line telephones, IP-equipped telephones, cellular radiotelephones, satellite phones, and computers with IP telephony capabilities.

In the case of wireless communication, voice communication devices 12 may communicate according to one or more wireless communication standards such as CDMA, GSM, WCDMA, and the like. In addition to voice communication, voice communication devices 12 may be capable of transmitting and receiving data via network 14. Hence, network 14 may represent a packet-based network, a switched telecommunication network, or a combination thereof.

Voice communication devices 12 may be equipped with variable rate vocoders that compress moments of sound into sequences of bits referred to as encoded voice frames. In accordance with this disclosure, one or more of voice communication devices 12 may implement techniques for condensed voice buffering, transmission and/or playback.

The techniques implemented by voice communication devices 12 may involve identification of encoded voice frames as representing either speech or a pause, and selective exclusion of frames for storage, transmission or playback based on the identification. In this manner, the techniques are capable of condensing, i.e., shortening, a series of encoded voice frames. Condensation may be effective in reducing the amount of frames stored in memory, transmitted between devices, or decoded and synthesized for playback.

When variable rate coding is employed, voice communication device 12 may identify a pause frame, for example, based on a threshold comparison for the rate of the encoded frame. In some cases, the condensation techniques implemented by voice communication device 12 may involve excluding only a portion of the identified pause frames from a consecutive sequence of the identified frames, thereby preserving a minimum number of the identified frames needed for intelligible conversation, as some amount of pause may be a necessary component of conversation.

Condensation may take place within a "sending" voice communication device 12 that encodes frames based on voice input. The voice input may be entered via a microphone associated with the sending voice communication device 12. In this case, the condensation may occur prior to buffering of the frames in memory. In other words, voice communication device 12 may exclude pause frames produced by the vocoder before the frames are stored in memory. Alternatively, voice communication device 12 may exclude the pause frames upon retrieval from memory, but prior to transmission via network 14.

Condensation also may take place within a "receiving" voice communication device 12 that decodes frames and synthesizes the frame content to produce voice output. Voice output may be produced by a speaker associated with the receiving voice communication device 12. In this case, the encoded voice frames are sent across network 14 and stored in memory at the receiving voice communication device 12. However, the receiving voice communication device 12 does not decode all of the encoded voice frames. Instead, the receiving voice communication device 12 excludes selected pause frames from decoding, synthesis and playback.

Condensing encoded voice frames prior to storage in memory, i.e., in a sending voice communication device 12, can promote more optimal storage within memory without changing the format or coding of the stored information. If QCELP encoding is employed, for example, voice communication device 12 can be configured to selectively exclude pause frames without altering the QCELP coding. Conversely, there is also no need to change the techniques for decoding and synthesizing the stored QCELP frames upon transmission to receiving voice communication device 12. Rather, there are simply less pause frames to decode at the receiving voice communication device 12.

With condensation of frames prior to storage, it may be possible to reduce memory requirements within voice communication device 12. Condensation may be used in combination with additional compression to further improve storage utilization. In addition, by reducing the number of frames associated with a speech sequence, condensation can promote conversation of transmission bandwidth, reduced processing overhead, reduced power consumption, and reduced latency. With respect to latency, in particular, condensation can be used to reduce network delays introduced by channel setup and maintenance.

Similarly, condensing encoded voice frames already stored in memory at the sending voice communication device 12, e.g., prior to transmission to a receiving voice communication device 12, can promote conservation of transmission bandwidth, reduced processing overhead, reduced power consumption, and reduced latency. Condensing encoded voice frames already stored in memory at the receiving voice communication device 12 can reduce processing overhead and power consumption need for decoding, synthesis and playback. For example, excluding frames from a series of frames for playback reduces the number of frames that need to be decoded and synthesized. Power conservation may be particularly advantageous for mobile, battery-powered voice communication devices.

Figure 2:
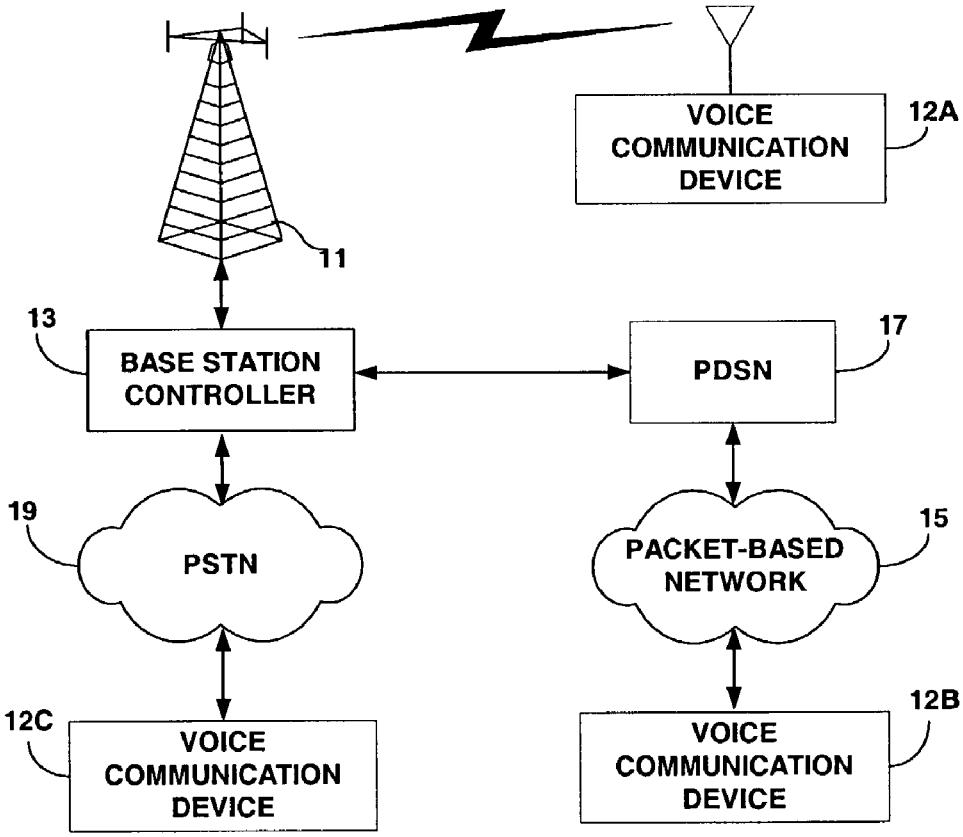
FIG. 2 is a block diagram illustrating an exemplary voice communication system in greater detail.

FIG. 2 is a block diagram illustrating voice communication system 10 in greater detail. In particular, FIG. 2 illustrates one possible environment for operation of voice communication devices 12 and implementation of a voice condensing techniques as described herein. As shown in FIG. 2, a first voice communication device 12A may take the form of a wireless device that communicates with a base station transceiver 11. A base station controller 13 may provide access to a packet-based network 15 via a packet data serving node 17. Base station 12 also may provide access to telephones or telephony devices coupled to public switched telephone network (PSTN) 19. In this manner, base station controller 12 may route calls between voice communication devices 12 and other remote network equipment or telephony equipment connected to packet-based network 15 or PSTN 19.

Voice communication device 12A communicates with voice communication device 12B via packet-based network 15, and communicates with voice communication device 12C via PSTN 19. Although voice communication devices 12A, 12B, and 12C are shown in FIG. 2 for purposes of illustration, system 10 may contain a large number of voice communication devices. Voice communication device 12B may receive voice information in the form of IP packets containing encoded voice frames. As described herein, voice communication devices 12A, 12B may employ condensation techniques to selectively exclude pause frames from the encoded voice frames sent and received by the devices.

Figure 3:
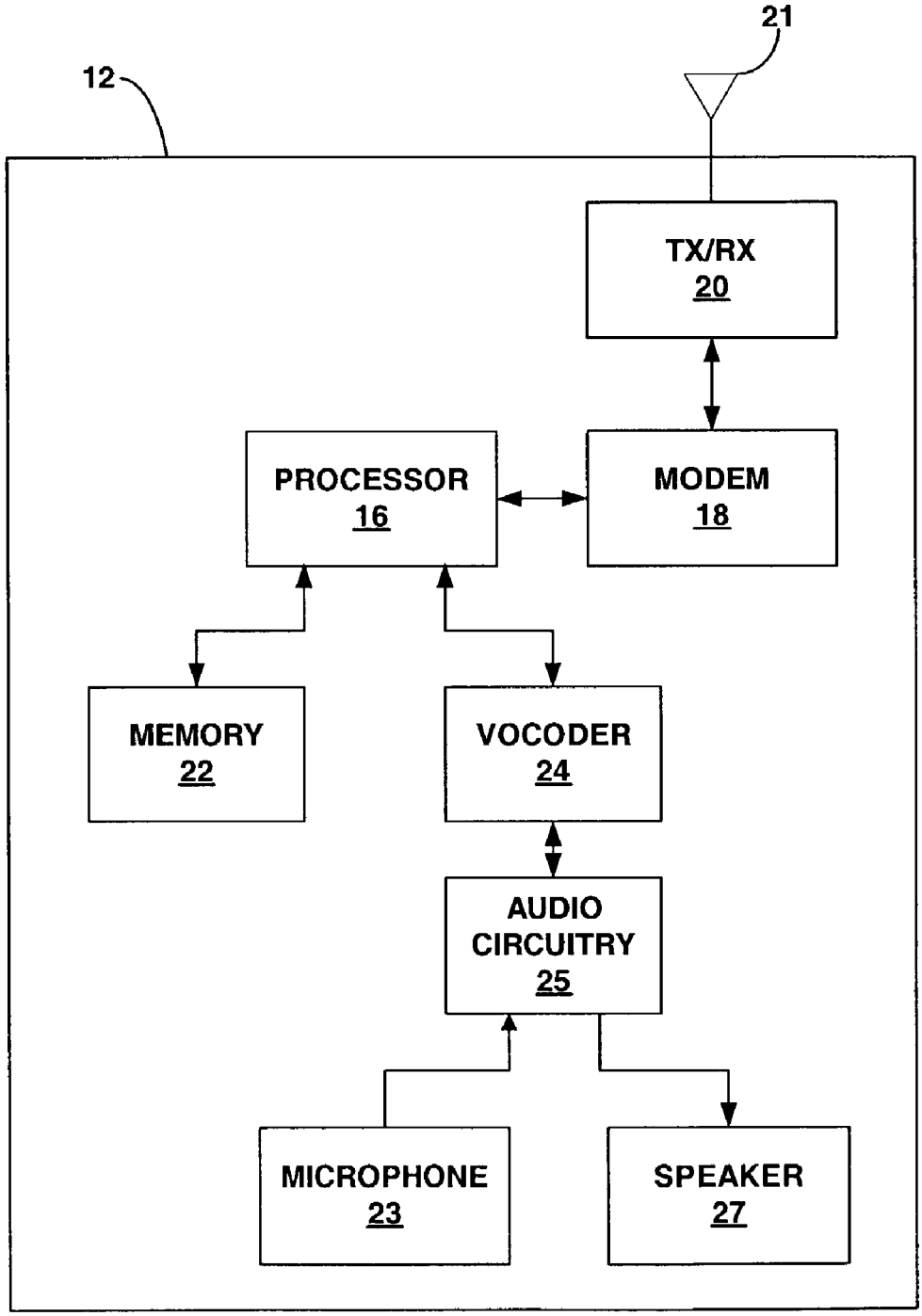
FIG. 3 is a block diagram of an exemplary voice communication device.

FIG. 3 is a block diagram of a voice communication device 12 in greater detail. In the example of FIG. 3, voice communication device 12 takes the form of a wireless communication device such as a cellular radiotelephone. As shown in FIG. 3, voice communication device 12 may include a processor 16, a modem 18, transmit/receive circuitry 20, memory 22 and vocoder 24. Processor 16 controls modem 18 to transmit and receive communications via transmitter/receiver circuitry 20. Transmit/receive circuitry 20 transmits and receives wireless signals via a radio frequency antenna 21.

As further shown in FIG. 3, processor 16 also may process user input, including text received from a keypad or other input media (not shown). Vocoder 24 receives voice input received from a microphone 23 via audio circuitry 25. Vocoder 24 encodes and compresses the voice input received from microphone 23 using an encoding technique such as QCELP, EVRC, SMV or the like. In addition, vocoder 24 decodes and synthesizes encoded voice frames received via transmit/receive circuitry 20. Audio circuitry 25 drives speaker circuitry 27 to produce audible voice output based on the results provided by vocoder 24.

Processor 16 executes instructions stored in memory 22 to control communications and implement voice condensation techniques as described herein. Memory 22 may take the form of random access memory (RAM), read-only memory (ROM), non-volatile random access memory (NVRAM), electrically erasable programmable read-only memory (EEPROM), flash memory, and the like. Memory 22 also may serve as a buffer for encoded voice frames processed by vocoder 24. Alternatively, a dedicated voice buffer may be provided.

In some embodiments, vocoder 24 may be integrated with processor 16 or modem 18. Alternatively, processor 16, modem 18 and vocoder 24 may be integrated together as a single processing unit. Accordingly, although FIG. 3 depicts processor 16, modem 18 and vocoder 24 as separate units, they may be implemented in a variety of different arrangements using shared hardware. For example, the functions performed by processor 16, modem 18 and vocoder 24 may be programmable features of a microprocessor or DSP, or features implemented in an ASIC, FPGA, discrete logic circuitry or the like. Moreover, in some embodiments, certain functions attributed to processor 16, modem 18 and vocoder 24 may be performed by the other units.

In operation, processor 16 identifies encoded voice frames, produced by vocoder 24, that represent a pause, and selectively excludes at least some of the identified frames from a series of frames to be stored in memory 22, transmitted via transmit/receive circuitry 20, or retrieved from memory 22 for decoding, synthesis and playback by vocoder 24. In this manner, processor 16 can be configured to promote memory, bandwidth, power, and processing efficiency as well as reduced latency.

Figure 4:
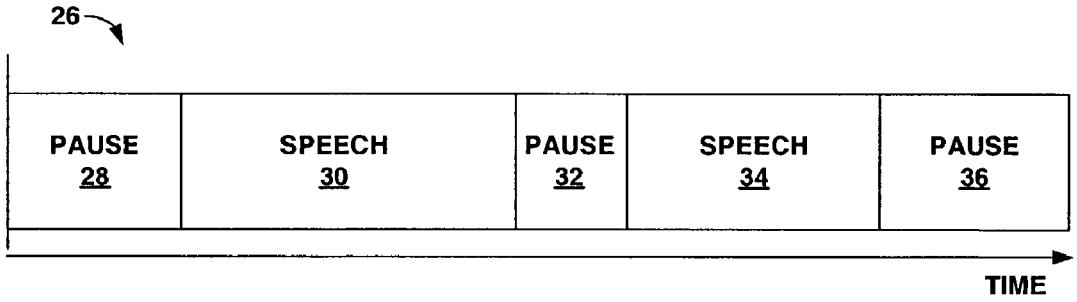
FIG. 4 is a timing diagram of an exemplary speech sequence.

FIG. 4 is a timing diagram of an exemplary speech sequence 26. Although speech sequences vary based on the course of a conversation, they are generally characterized by bursts of speech, or "utterances," separated by periods of no speech, i.e., pauses. Indeed, to be intelligible, speech ordinarily must include pauses between utterances. Hence, upon voice encoding, certain frames will contain the encoding of pauses. As shown in FIG. 4, a particular speech sequence 26 includes a pause period 28, followed by speech period 30, pause period 32, speech period 34 and pause period 36.

Figure 5:
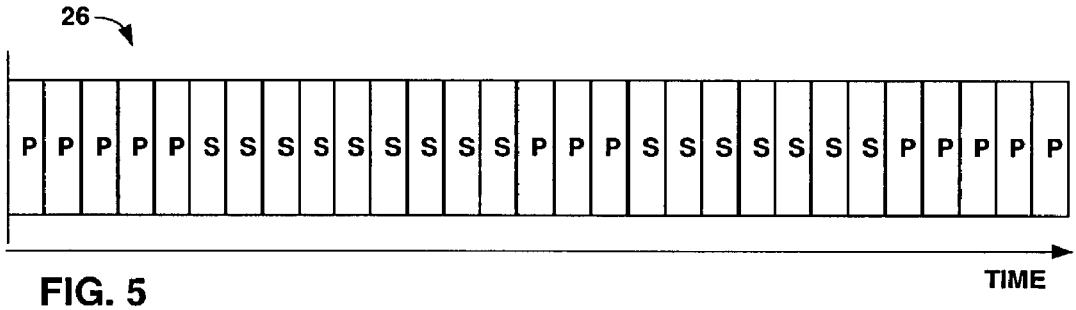
FIG. 5 is a timing diagram of the speech sequence of FIG. 4 following encoding to produce a series of encoded voice frames.

FIG. 5 is a timing diagram of the speech sequence 26 of FIG. 4 following encoding to produce a series of encoded voice frames. Each frame is designated as either a pause (P) frame or a speech (S) frame. Ordinarily, a variable rate vocoder will encode pause frames and speech frames at different rates. Accordingly, pause and speech frames can be readily distinguished by comparing the encoding rate to a threshold rate. In particular, a pause frame typically will be encoded at a lower rate than a frame containing speech.

Figure 6:
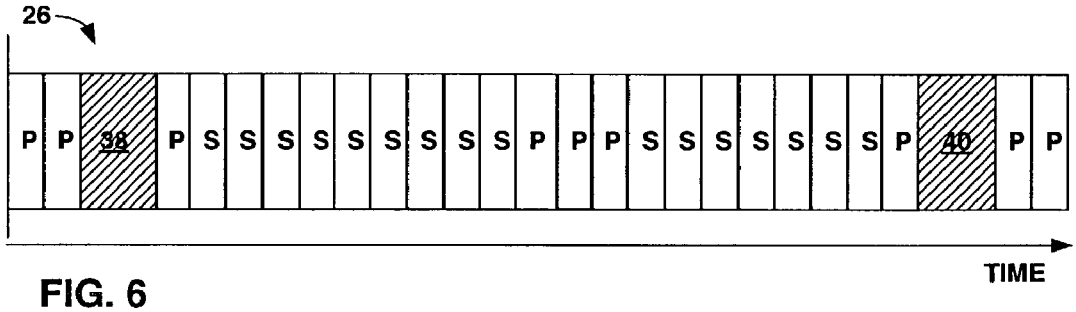
FIG. 6 is a timing diagram of the encoded voice frames of FIG. 5 illustrating identification of pause frames to be excluded from the frame series.

FIG. 6 is a timing diagram of the encoded voice frames of FIG. 5 illustrating identification of pause frames to be excluded from the frame series in accordance with the condensation techniques described herein. Because speech sequence 26 is encoded frame-by-frame, the pauses between utterances can be shortened by removing some of the pause frames. As shown in FIG. 6, pause frames corresponding to areas 38 and 40 are eliminated to condense the overall length of speech sequence 26. Area 38 and 40 each correspond to two pause frames, in the example of FIG. 6, that are excluded from the series of frames representing speech sequence 26.

Notably, not all of the pause frames are excluded in the example of FIG. 6. Rather, in many cases, it will be desirable to exclude only a portion of the pause frames to thereby preserve the intelligibility of speech sequence 26. If all of the pause frames were removed, there would be no separation between speech frames, resulting in speech output that is either unintelligible or difficult to understand. Accordingly, the condensation techniques applied to speech sequence 26 may make use of a minimum pause length threshold to retain a sufficient number of pause frames for intelligibility. Thus, the minimum pause length may be based on the intelligibility needs of the decoded speech.

In addition to intelligibility, encoded pauses can contain useful information, such as metrics for a background noise level. A receiving device typically uses the background noise level to adjust gain or other playback parameters. To maintain the most up-to-date information, it may be desirable to retain the last frame in a pause, i.e., the last frame in a series of consecutive pause frames. In this case, the pause frames to be excluded can be taken from the beginning or middle of a series of pause frames. At least some of the pause frames are retained in the frame series to permit intelligibility and, optionally, to retain other useful information, such as the background noise level.

The threshold for pause frame retention may be an absolute number of frames. For example, the condensation process may be configured to exclude only those pause frames in excess of a minimum number of pause frames. Alternatively, the process could be configured to retain a relative pause length. In this case, a minimum percentage of pause frames are retained. Thus, following condensation, a longer pause may retain more frames than a shorter pause. Again, the threshold may work in conjunction with retention of the last frame of a pause, i.e., a last frame rule, for background noise level.

As an example of the application of a threshold and last-frame rule, FIG. 6 illustrates retention of all of the pause frames associated with pause 32. Whereas pause 28 and pause 36 are modified to exclude a number of pause frames, pause 32 is unchanged due to the effects of the retention threshold and the last frame rule. The results provided in FIG. 6 are for purposes of illustration only. Results may vary according to the particular retention threshold and whether a last frame rule applies.

Figure 7:
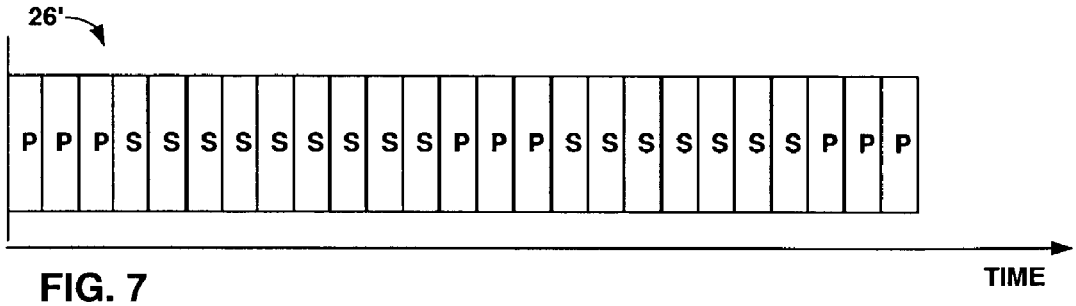
FIG. 7 is a timing diagram of the encoded voice frames of FIG. 6 following exclusion of the identified pause frames.

FIG. 7 is a timing diagram of the encoded voice frames of FIG. 6 following exclusion of the identified pause frames. As indicated in FIG. 7, the result is a shortened series of encoded voice frames. Upon playback, the pauses between utterances are reduced, but not so much as to adversely affect intelligibility. Over the course of several speech sequences, exclusion of pause frames can result in substantial savings in latency, and reduce bandwidth, power and processing consumption.

Figure 8:
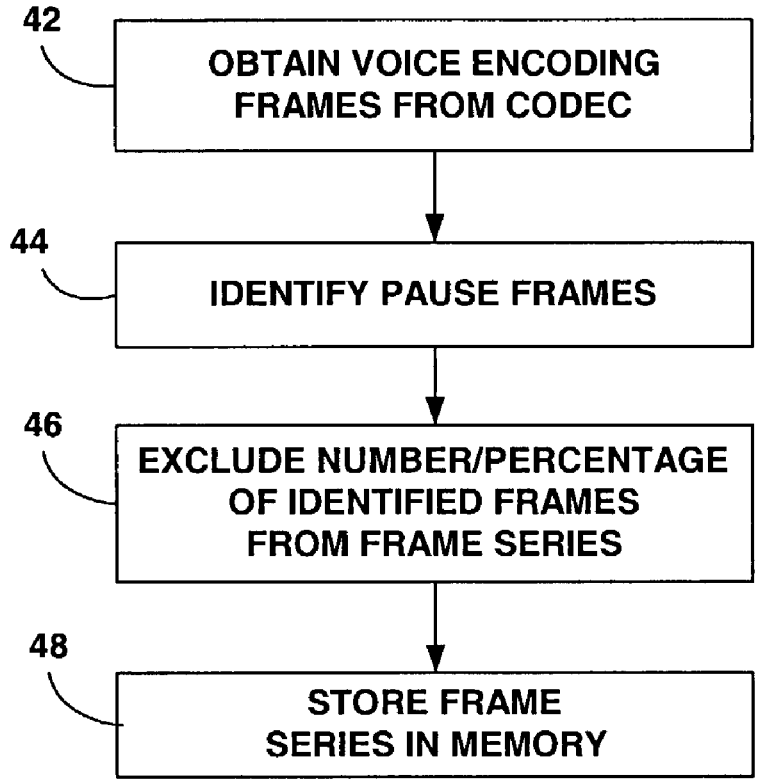
FIG. 8 is a flow diagram illustrating exclusion of pause frames for storage of a series of encoded voice frames in memory.

FIG. 8 is a flow diagram illustrating exclusion of pause frames for storage of a series of encoded voice frames in memory. In particular, FIG. 8 represents exclusion of pause frames produced by a vocoder within a sending voice communication device 12 prior to buffering to conserve memory resources. By storing a reduced length speech sequence, however, bandwidth, latency, processing and power consumption advantages also may result.

As shown in FIG. 8, the condensation technique may involve obtaining a series of encoded voice frames from a vocoder (42), and identifying encoded voice frames representing a pause (44). The technique further involves excluding either an absolute number or a specified percentage of the identified pause frames from the series of encoded voice frames (46), subject to minimum pause length and last frame rules as discussed above. Upon excluding the pause frames, the technique involves storing the pause-shortened frame series in memory (48), such as memory 22 shown in FIG. 3.

Figure 9:
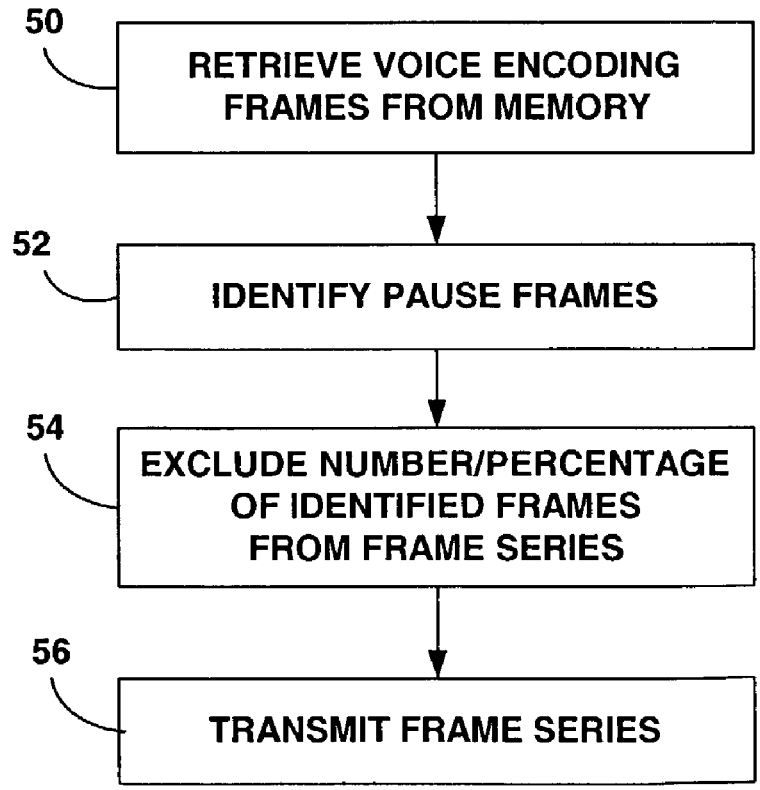
FIG. 9 is a flow diagram illustrating exclusion of pause frames for transmission of a series of encoded voice frames.

FIG. 9 is a flow diagram illustrating exclusion of pause frames for transmission of a series of encoded voice frames. In particular, FIG. 9 represents exclusion of pause frames produced by a vocoder within a sending voice communication device 12 prior to transmission of frames representing a speech sequence. In this case, all of the frames produced by the vocoder are stored in memory, but at least some of the pause frames are omitted prior to transmission. By transmitting a reduced length speech sequence, bandwidth, latency, processing and power consumption advantages may result.

As shown in FIG. 9, the condensation technique may involve retrieving a series of encoded voice frames from memory (50), and identifying encoded voice frames representing a pause (52). The technique further involves excluding either an absolute number or a specified percentage of the identified pause frames from the series of encoded voice frames (54), subject to minimum pause length and last frame rules. Upon excluding the pause frames, the technique involves transmitting the pause-shortened frame series (56), e.g., to a receiving voice communication device 12.

Figure 10:
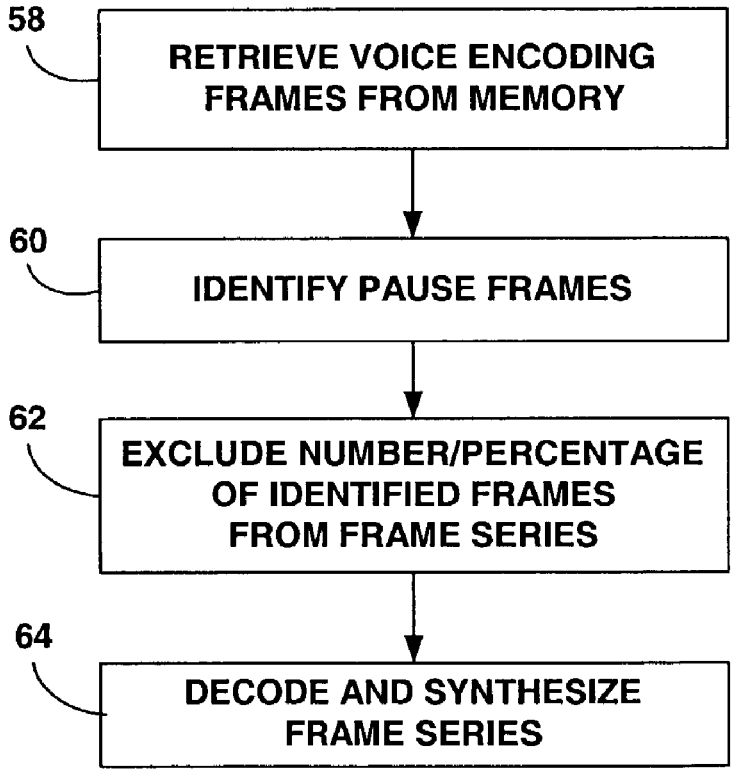
FIG. 10 is a flow diagram illustrating exclusion of pause frames for playback of a series of encoded voice frames.

FIG. 10 is a flow diagram illustrating exclusion of pause frames for playback of a series of encoded voice frames. In particular, FIG. 10 represents exclusion of pause frames retrieved from memory in a receiving voice communication device 12 to reduce the number of frames decoded and synthesized by a vocoder residing in the device prior to playback. In this case, all of the frames received from a sending voice communication device 12 are stored in memory in the receiving voice communication device, but at least some of the pause frames are omitted prior to decoding, synthesis and playback. By decoding a reduced length speech sequence, processing and power consumption advantages may result in the receiving voice communication device 12.

As shown in FIG. 10, the condensation technique may involve retrieving a series of encoded voice frames from memory (58), and identifying encoded voice frames representing a pause (60). The technique further involves excluding either an absolute number or a specified percentage of the identified pause frames from the series of encoded voice frames (62), subject to minimum pause length and last frame rules. Upon excluding the pause frames, the technique involves decoding and synthesizing the pause-shortened frame series (64) for playback. In some embodiments, exclusion of stored pause frames may be accomplished by skipping forward past the stored pause frames as a frame series is read from memory.

Figure 11:
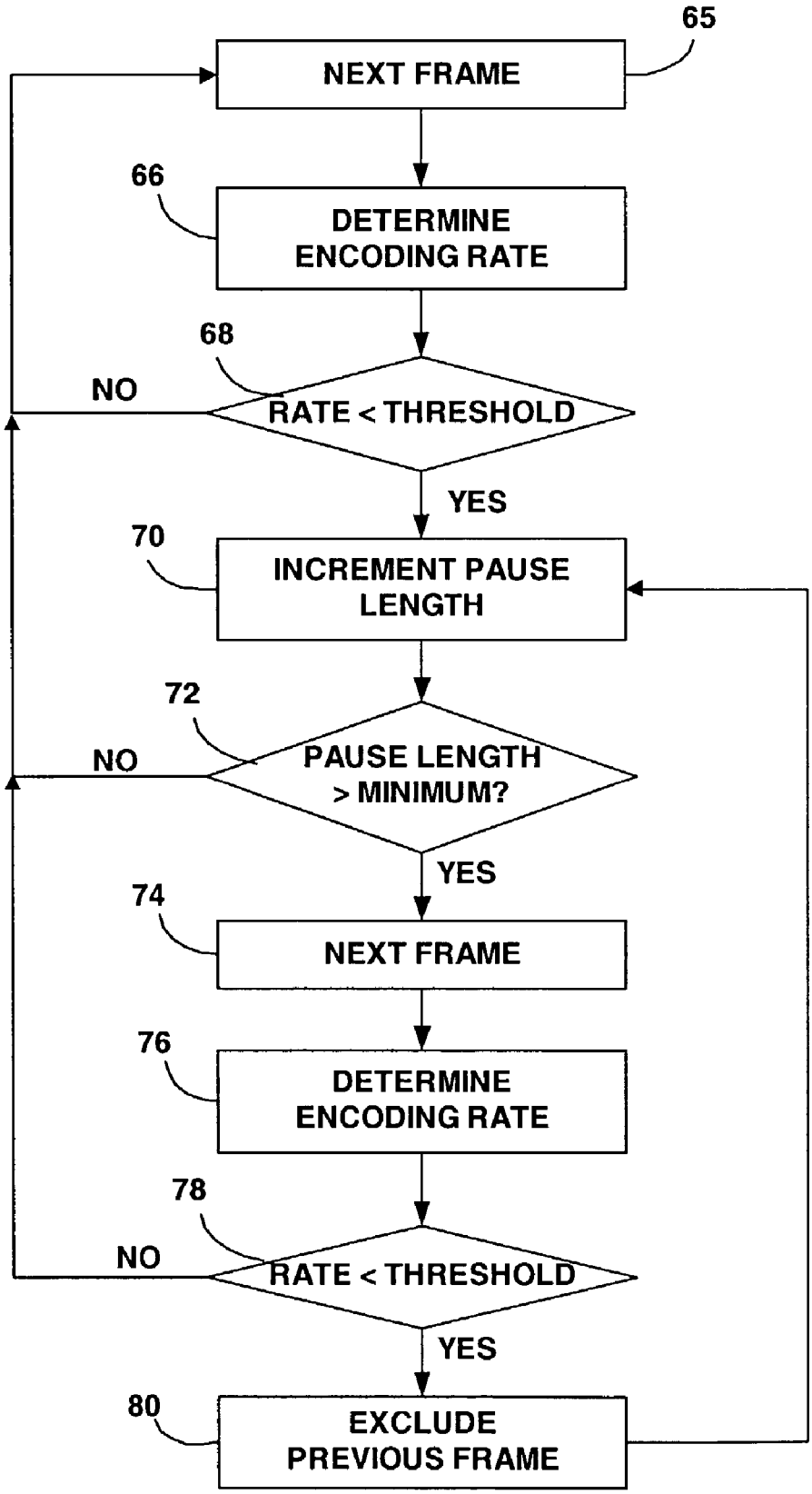
FIG. 11 is a flow diagram illustrating a technique for identification and selection of pause frames for exclusion from a series of encoded voice frames.

FIG. 11 is a flow diagram illustrating identification and selection of pause frames for exclusion from a series of encoded voice frames. In particular, FIG. 11 illustrates techniques that may be used for identification and exclusion of pause frames for the condensation techniques described above with respect to FIGS. 8-10. As shown in FIG. 11, upon receipt of the next frame (65) in a series of encoded voice frames, the technique involves determination of the encoding rate associated with the frame (66).

The encoding rate indicates whether the frame contains a pause or speech. For example, vocoder 24 may encode frames at full rate, half rate, one-quarter rate, or one-eighth rate. Typically, vocoder 24 will encode pauses at one-eighth rate, permitting ready identification of pause frames. If the encoding rate of the frame is above a certain threshold (68), the frame is not a pause frame, and the process continues to consideration of the next frame (65). If the encoding rate is below the threshold (68), however, the frame is a pause frame. In this case, a pause length value is incremented (70). The pause length value represents the running length of a pause, as indicated by the number of consecutive pause frames identified in a speech sequence. Upon identification of a speech frame, the pause length value can be reset.

Using the pause length value, the technique further involves determining whether the number of pause frames is greater than a minimum number (72). Again, the minimum may be an absolute number of frames, or a dynamically calculated number that represents a minimum percentage of the frames in a pause. If the pause length is not greater than the minimum (72), the present pause frame is not excluded. Instead, the technique proceeds to consideration of the next frame. If the pause length is greater than the minimum (72), however, the technique proceeds to consideration of the next frame (74) for application of a last pause frame rule.

As discussed above, a last pause frame rule may require retention of the last pause frame in a consecutive series of pause frames to provide a current background noise measurement for decoding. Upon determining the encoding rate of the present frame (76) and comparing the encoding rate to the rate threshold (78), the technique determines whether the frame is a pause frame. If the frame is not a pause frame, as indicated by an encoding rate that is greater than the threshold, the previous frame was the last pause frame and must be retained. In this case, the process proceeds to the next frame.

If the frame is a pause frame, as indicated by an encoding rate that is greater than the threshold, the previous frame was not the last pause frame. Accordingly, the previous frame is excluded from the series of encoded voice frames (80), and the technique proceeds to increment the pause length value (70). From that point, the technique proceeds to consideration of the present frame in view of the minimum pause length (72) and last pause frame rules, and continues in like fashion for remaining frames in the series of encoded voice frames.

Figure 12:
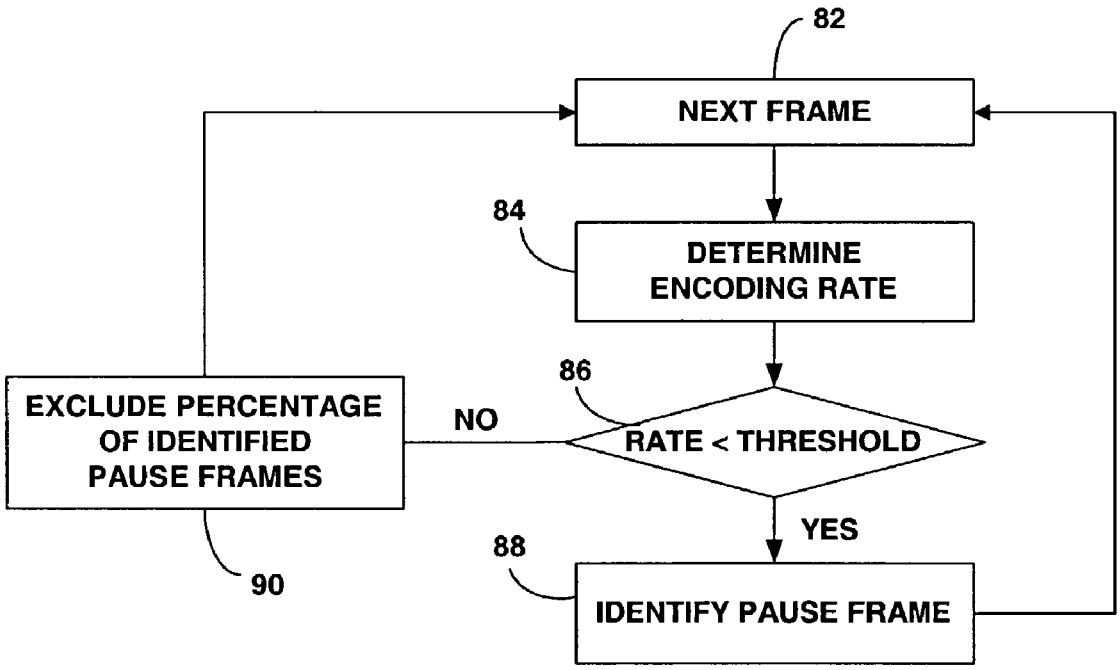
FIG. 12 is a flow diagram illustrating another technique for identification and selection of pause frames for exclusion from a series of encoded voice frames.

FIG. 12 is a flow diagram illustrating another technique for identification and selection of pause frames for exclusion from a series of encoded voice frames. FIG. 12 illustrates techniques that may be used for identification and exclusion of pause frames for the condensation techniques described above with respect to FIGS. 8-10. In contrast to the technique of FIG. 11, which generally involves exclusion of pause frames on a frame-by-frame basis, the technique of FIG. 12 illustrates exclusion of a group of pause frames. In particular, upon identifying a consecutive sequence of pause frames, i.e., by identifying the start and end of the pause frame sequence, the technique of FIG. 12 involves excluding a percentage of the pause frames.

As shown in FIG. 12, upon receipt of the next frame (82) in a series of encoded voice frames, the technique involves determination of the encoding rate associated with the frame (84). Again, the encoding rate indicates whether the frame contains a pause or speech. If the encoding rate of the frame is below a certain threshold (86), the frame is identified as a pause frame (88). The process continues to consideration of the next frame (82). If the encoding rate is above the threshold (86), however, the frame is not identified as a pause frame. In this case, the end of the pause sequence has been reached. In particular, when a non-pause frame is identified following a sequence of pause frames, the technique detects the end of the pause sequence.

At this point, a percentage of the identified pause frames are excluded (90) from the series of encoded voice frames. If ten pause frames were identified, for example, and a reduction percentage of 80% were selected, then eight of the ten pause frames would be excluded. The process then continues with consideration of the next encode voice frame (82). This technique may be accomplished, for example, by working through a sequence of encoded voice frames and buffering intermediate frames so that pause frames can be excluded from a final series of frames to be output, e.g., for buffering, transmission or playback.

The techniques described herein may be implemented in hardware, software, firmware, or any combination thereof. If implemented in software, the techniques may be realized by a computer readable medium comprising instructions that, when executed, performs one or more of the techniques described above. In that case, the computer readable medium may comprise random access memory (RAM) such as synchronous dynamic random access memory (SDRAM), read-only memory (ROM), non-volatile random access memory (NVRAM), electrically erasable programmable read-only memory (EEPROM), FLASH memory, magnetic or optical data storage media, and the like.

The program code may be stored on memory in the form of computer readable instructions. In that case, a processor 16, such as a DSP, provided in a voice communication device 12 may execute instructions stored in memory in order to carry out one or more of the techniques described herein. In some cases, the techniques may be executed by a DSP that invokes various hardware components. In other cases, processor 16, modem 18 or vocoder 24 may be implemented as a microprocessor, one or more application specific integrated circuits (ASICs), one or more field programmable gate arrays (FPGAs), or some other hardware-software combination. Although much of the functionality described herein may be attributed to processor 16 for purposes of illustration, the techniques described herein may be practiced within processor 16, modem 18, vocoder 24, or a combination thereof. In addition, structure and function associated with processor 16, modem 18 and vocoder 24 may be integrated and subject to wide variation in implementation.

Communication media typically embodies processor readable instructions, data structures, program modules, or other data in a modulated data signal, such as a carrier wave or other transport medium and includes any information delivery media. The term "modulated data signal" means a signal that has one or more of its characteristics set or changed in such a manner as to encode information in the signal. By way of example, and not limitation, communication media includes wired media, such as a wired network or direct-wired connection, and wireless media, such as acoustic, RF, infrared, and other wireless media. Computer readable media may also include combinations of any of the media described above.

Various embodiments have been described. These and other embodiments are within the scope of the following claims. For example, condensation techniques described herein may be performed within voice communication devices, such as cellular radiotelephones. Alternatively, the condensation techniques may be performed within network equipment responsible for forwarding packets containing the encoded voice frames, particularly for multicasting environments such as point-to-multipoint communication.

The invention claimed is:

1. A method performed by a communication device, comprising the steps of:

receiving a speech sequence at a microphone of the communication device, the speech sequence comprising bursts of speech and periods without speech comprising background noise;

encoding the speech sequence at a vocoder of the communication device to produce a series of encoded voice frames representative of the speech sequence, wherein each frame of the series of encoded voice frames corresponding to the bursts of speech comprises a speech frame representing speech and wherein each frame of the series of encoded voice frames corresponding to the periods without speech comprises a pause frame representing a pause;

identifying the pause frames in the series of encoded voice frames;

excluding at least some of the identified pause frames corresponding to a respective period without speech as represented by the series of encoded voice frames while retaining a minimum pause length corresponding to the respective period without speech and while retaining at least one of the identified pause frames having the background noise in the respective period without speech to thereby produce a pause-shortened series of encoded voice frames, wherein a playback time of the respective period without speech as represented by the shortened series of encoded voice frames is reduced; and storing at least one of the series of encoded voice frames or the pause-shortened series of encoded voice frames in a memory.

2. The method of claim 1, wherein the step of storing comprises storing the series of encoded voice frames in the memory, and transmitting the pause-shortened series of encoded voice frames via a communication medium, wherein the step of excluding is performed after the step of storing of the series of encoded voice frames in the memory and prior to transmitting.

3. The method of claim 1, wherein the step of storing comprises storing the series of encoded voice frames in the memory, and retrieving the series of encoded voice frames from the memory, wherein the step of excluding is performed upon retrieving.

4. The method of claim 1, wherein identifying the pause frames further comprises:

comparing an encoding rate of each of the series of encoded voice frames to a threshold; and identifying the pause frames based on the comparison.

5. The method of claim 1, wherein the step of excluding further comprises excluding only a portion of the identified pause frames from a consecutive sequence of the identified pause frames.

6. The method of claim 5, wherein the step of excluding further comprises excluding a percentage of the identified pause frames from a consecutive sequence of the identified pause frames.

7. The method of claim 6, further comprising determining the percentage based on a minimum number of the identified pause frames needed for intelligible conversation.

8. The method of claim 5, further comprising determining a number of the identified pause frames to exclude from a consecutive sequence of the identified pause frames based on a minimum number of the identified pause frames needed for intelligible conversation.

9. The method of claim 1, wherein retaining the at least one of the identified pause frames having the background noise further comprises retaining at least the last frame of a consecutive sequence of the identified pause frames in the series of encoded voice frames, wherein the last frame comprises an indicator of the latest level of the background noise operable for use in adjusting a playback parameter.

10. The method of claim 1, wherein the speech sequence is shortened in playback time only because of the shortening of pauses represented by the pause-shortened series of encoded voice frames associated with the excluded pause frames.

11. A device comprising:

a voice encoder for receiving a speech sequence comprising bursts of speech and periods of no speech comprising background noise, and generating a series of encoded voice frames representative of the speech sequence. wherein each frame of the series of encoded voice frames corresponding to the bursts of speech comprises a speech frame representing speech and wherein each frame of the series of encoded voice frames corresponding to the periods of no speech comprises a pause frame representing a pause;

a processor for:

identifying the pause frames in the series of encoded voice frames; and excluding at least some of the identified pause frames corresponding to a respective period of no speech as represented by the series of encoded voice frames while retaining a minimum pause length corresponding to the respective period of no speech and while retaining at least one of the identified pause frames having the background noise in the respective period of no speech to thereby produce a pause-shorten series of encoded voice frames, wherein a playback time of the respective period of no speech as represented by the shortened series of encoded voice frames is reduced; and a memory for storing at least one of the series of encoded voice frames or the pause-shortened series of encoded voice frames.

12. The device of claim 11, wherein the memory stores the series of encoded voice frames in the memory, and further comprising a transmitter operable to transmit the pause-shortened series of encoded voice frames via a communication medium, wherein the processor is further operable to perform the excluding after the storing of the series of encoded voice frames in the memory and prior to the transmitting.

13. The device of claim 11, wherein the memory stores the pause-shortened series of encoded voice frames in the memory, and further comprising:

a voice decoder for retrieving and decoding the pause-shortened series of encoded voice frames from the memory to produce a voice output, wherein the processor is operable to perform the excluding upon the retrieving.

14. The device of claim 11, wherein in identifying the pause frames, the processor compares an encoding rate of each of the series of encoded voice frames to a threshold and identifies the pause frames based on the comparison.

15. The device of claim 11, wherein in excluding at least some of the identified pause frames, the processor excludes only a portion of the identified pause frames from a consecutive sequence of the identified pause frames.

16. The device of claim 15, wherein the processor excludes a percentage of the identified pause frames from a consecutive sequence of the identified pause frames.

17. The device of claim16 wherein the processor determines the percentage based on a minimum number of the identified pause frames needed for intelligible conversation.

18. The device of claim 15, wherein the processor determines a number of the identified pause frames to exclude from a consecutive sequence of the identified pause frames based on a minimum number of the identified frames needed for intelligible conversation.

19. The device of claim 11, wherein in retaining the at least one of the identified pause frames having the background noise, the processor retains at least the last frame of a consecutive sequence of the identified pause frames in the series of encoded voice frames, wherein the last frame comprises an indicator of the latest level of the background noise operable for use in adjusting a playback parameter.

20. A machine-readable medium stored in memory and comprising instructions to cause a processor to:

receive a speech sequence comprising bursts of speech and periods of no speech comprising background noise;

encode the speech sequence to produce a series of encoded voice frames representative of the speech sequence, wherein each frame of the series of encoded voice frames corresponding to the bursts of speech comprises a speech frame representing speech and wherein each frame of the series of encoded voice frames corresponding to the periods of no speech comprises a pause frame representing a pause;

identify the pause frames in the series of encoded voice frames;

exclude at least some of the identified pause frames corresponding to a respective period of no speech as represented by the series of encoded voice frames while retaining a minimum pause length corresponding to the respective period of no speech and while retaining at least one of the identified pause frames having the background noise in the respective period of no speech to thereby produce pause-shortened series of encoded voice frames, wherein a playback time of the respective period of no speech as represented by the shortened series of encoded voice frames is reduced; and store the pause-shortened series of encoded voice frames in a memory.

21. A device comprising:

means for generating a series of encoded voice frames representative of a received speech sequence comprising bursts of speech and periods of no speech comprising background noise, wherein each frame of the series of encoded voice frames corresponding to the bursts of speech comprises a speech frame representing speech and wherein each frame of the series of encoded voice frames corresponding to the periods of no speech comprises a pause frame representing a pause;

means for identifying the pause frames in the series of encoded voice frames; and means for excluding at least some of the identified pause frames corresponding to a respective period of no speech as represented by the series of encoded voice frames while retaining a minimum pause length corresponding to the respective period of no speech and while retaining at least one of the identified pause frames having the background noise in the respective period of no speech to thereby produce a pause-shortened series of encoded voice frames, wherein a playback time of the respective period of no speech as represented by the shortened series of encoded voice frames is reduced; and means for storing the pause-shortened series of encoded voice frames.

* * * * *

UNITED STATES PATENT AND TRADEMARK OFFICE

CERTIFICATE OF CORRECTION

PATENT NO. : 7,542,897 B2
APPLICATION NO. : 10/233251
DATED : June 2, 2009
INVENTOR(S) : Hutchison et al.

It is certified that error appears in the above-identified patent and that said Letters Patent is hereby corrected as shown below:

Column 11, line 31, claim 11: “pause-shorten” to read as --pause-shortened--

Signed and Sealed this
Fourteenth Day of June, 2011

David J. Kappos

David J. Kappos
*Director of the United States Patent and Trademark Office*